US005839413A

United States Patent [19]

Krause et al.

[11] Patent Number: 5,839,413

[45] Date of Patent: Nov. 24, 1998

[54] QUICK START HEUI SYSTEM

[75] Inventors: Richard K. Krause, Wooster; Eric D. Ramseyer, Orrville, both of Ohio

[73] Assignee: The Rexroth Corporation, Wooster, Ohio

[21] Appl. No.: 846,242

[22] Filed: Apr. 28, 1997

[51] Int. Cl.[6] ..... F02M 7/00

[52] U.S. Cl. ..... 123/447; 123/179.17

[58] Field of Search ..... 123/446, 447, 123/467, 456, 179.16–179.17, 179.9

[56] References Cited

U.S. PATENT DOCUMENTS 5,121,730 6/1992 Ausman et al. .
5,213,083 5/1993 Glassey .
5,245,970 9/1993 Iwaszkiewicz et al. .
5,456,233 10/1995 Felhofer ..... 123/447
5,471,959 12/1995 Sturman ..... 123/447
5,546,912 8/1996 Yamada et al. ..... 123/179.16
5,711,263 1/1998 Brown ..... 123/179.9

*Primary Examiner*—Thomas N. Moulis
*Attorney, Agent, or Firm*—Frank J. Nawalanic

[57] ABSTRACT

A priming system for a hydraulically actuated, electronically controlled unit injector fuel systems used on diesel engines and the like includes an accumulator charged at low pressure and in fluid communication with the manifold/rail passages leading to the individual fuel injectors, which passages are pressurized upon engine startup by the system's high pressure pump to actuate the injectors. The accumulator is plumbed into the hydraulic system by one way check valves which isolate the accumulator from the high pressure pump to permit the high pressure pump and the priming system to be located at any convenient position within the vehicle's engine compartment irrespective of their position relative to the manifold/rail passages.

16 Claims, 4 Drawing Sheets

QUICK START HEUI SYSTEM

This invention relates generally to fuel injection systems for engines and more particularly to hydraulically actuated, electronically controlled unit injector fuel systems (HEUI) for internal combustion engines.

The invention is specifically applicable to an oil priming/volume compensating system for use in a HEUI fuel injection system to alleviate cold starting problems in diesel engines and will be described with specific reference thereto. However, those skilled in the art may recognize that the priming system could be used in hydraulically actuated injection systems used on gasoline engines and the like.

INCORPORATION BY REFERENCE

The following United States patents are incorporated herein by reference and made a part hereof so that details of conventional HEUI systems need not be explained in detail herein.

- U.S. Pat. No. 5,121,730, to Ausman et. al., dated Jun. 16, 1992, entitled "Methods of Conditioning Fluid in an Electronically-controlled Unit Injector for Starting";
- U.S. Pat. No. 5,213,083, to Glassey, dated May 25, 1993, entitled "Actuating Fluid Pump Having Priming Reservoir"; and,
- U.S. Pat. No. 5,245,970, to Iwaszkiewicz et. al., dated Sept. 21, 1993, entitled "Priming Reservoir And Volume Compensation Device for Hydraulic Unit Injector Fuel System".

The patents incorporated by reference herein do not form part of the present invention.

BACKGROUND

As is well known, a hydraulically-actuated electronically-controlled unit injector fuel system has a plurality of injectors, each of which, when actuated, meters a quantity of fuel into a combustion chamber in the cylinder head of the engine. Actuation of each injector is accomplished through valving of high pressure hydraulic fluid (engine oil) under the control of an electronic module. High pressure hydraulic actuating fluid is supplied to each injector by a high pressure pump in fluid communication with each injector through a manifold/rail fluid passage arrangement. If the manifold/rail passages don't remain full, then before the engine can be started, the high pressure pump must first fill the manifold/rail passages with oil before it can pressurize the fluid at a pressure sufficient to actuate the injectors. The engine must be turned over or cranked by the starter at a rate and for a time sufficient to accomplish this and results in hard starting of a "cold" engine. The problem occurs after the engine has been left standing for some time and internal leakage of some of the oil to the sump occurs in the manifold/rail passages, the injectors and the pump. In addition, a volumetric contraction of the oil inherently occurs when the hot engine oil cools to ambient temperature requiring make-up oil to keep the manifold/rail passages full.

The prior art has addressed this problem with some success by use of a priming reservoir which is shown in prior art FIG. 2 and described in U.S. Pat. Nos. 5,213,083 and 5,245,970 (as well as others) incorporated by reference herein. As shown, the prior art uses an atmosphere vented, priming reservoir which is connected to the inlet and through a syphon passage and one way check valve to the outlet of the high pressure pump and also to the manifold/rail passages to supply make-up oil. Importantly, the prior art reservoir is positioned above the inlet of the high pressure pump and above the manifold/rail passages so that the oil in the priming reservoir will flow by gravity and/or suction (siphon) to keep the manifold/rail passages and high pressure pump inlet passage filled with oil when the high pressure pump is not operating. The positioning of the priming reservoir also assists in the reservoir responding as a syphon when the volumetric contraction of the oil establishes a suction in the passages as the oil cools. The prior art system is tried and proven but is not trouble free. The priming reservoir is limited in size depending on engine application and typically is about ¼ liter. Internal leakage and volumetric contraction inherently occur with the result that the priming reservoir is partially drained. When the engine is turned by the starter upon startup, the high pressure pump pulls oil from the partially drained priming reservoir and it can effectively drain the priming reservoir producing the same hard starting conditions as if the manifold/rail passages were partially emptied.

Typically, in large truck applications, positioning the priming reservoir above the engine's manifold/rail is not a concern. However, there are certain vehicular type applications, such as sports utility vehicles, where hood to engine clearance prohibits mounting a reservoir at an elevation above the manifold/rail passages. In this connection, the prior art has noted that it is not practical to charge or pressurize the priming reservoir. It is believed this is one of the primary reasons the prior art selected the gravity flow arrangement described above. One of the possible reasons why it was not practical to pressurize or charge the priming reservoir can relate to the high pressure pump design and the internal leakage passages within the pump to return. For example, one type of conventional high pressure pump has a shaft seal arrangement which acts as a check valve to maintain proper case pressure during the pump operation. In this pump, the shaft seal could provide additional internal leakage paths to the sump when the pump doesn't operate if oil in the pump was pressurized. A charged reservoir could thus result in leakage through the pump as well as through the injectors.

The high pressure pump is typically sealed to be in static balance with the manifold/rail passages at pressure of 5 psi or less, and is essentially the pressure head caused by the height of the oil in the priming reservoir of the prior art. A charged reservoir over 5 psi could thus result in leakage through the pump. If leakage occurs in the prior art system described above, the leakage is most likely to occur through the injector.

SUMMARY OF THE INVENTION

Accordingly, it is a principal object of the invention to provide a priming system for use in an HEUI arrangement which employs a charged reservoir which can be positioned anywhere within the engine compartment while providing make-up oil to keep the injector manifold/rail passages full.

This object along with other features of the invention is achieved in an engine having a hydraulically-operated, electronically-controlled fuel injection system of the type which includes a fuel injector, a mechanism for supplying fuel to the injector, and a high pressure pump in fluid communication with a manifold which, in turn, is in fluid communication with the injector in combination with an electronic module controlling the pressure of the high pressure pump apart from the fuel supply to actuate the injector. In this HEUI system, the present invention has a priming system which includes a low pressure pump and an accumulator having an inlet and an outlet. A check valve arrangement between the inlet of the accumulator and the low pressure pump allows the low pressure pump to charge the accumulator at a preset pressure lower than that of the high pressure pump. A make-up fluid supply line with a one-way check valve between the accumulator outlet and the manifold permits the manifold/rail passages to be maintained in a fully primed condition at all times when the high pressure pump is inoperable while isolating the make-up system from the high pressure pump to assure quick start of a cold engine.

In accordance with another aspect of the invention, the accumulator can be easily plumbed into the vehicle's engine compartment wherever space is available since the accumulator will maintain the manifold in a fully primed condition irrespective of its location. Thus, the invention contemplates that the accumulator can be either affixed to the high pressure pump or can be positioned remote from the high pressure pump or can be integrally formed as a part of the high pressure pump.

In accordance with another aspect of the invention, a dual check valve arrangement is provided at the inlet of the accumulator with one check valve operable to permit the low pressure pump to charge the accumulator and the other check valve operable as a safety relief valve permitting the accumulator to charge the manifold in an arrangement completely isolated from the high pressure pump. Accordingly, the invention permits use of a conventional priming reservoir to only maintain oil at the high pressure pump's inlet thus assuring an adequate volume of oil to alleviate hard starting conditions attributed to an exhausted or partially exhausted priming reservoir.

It is thus a principal object of the subject invention to provide a priming system for use in an HEUI fuel injection system which assures quick starting of a cold engine.

It is another object of the invention to provide an accumulator in a priming system for an HEUI fuel injector arrangement which allows the high pressure pump and/or accumulator to be mounted at any position within the engine compartment including elevations below the height of the manifold/rail passages extending therefrom.

Still another object of the invention is to provide a priming arrangement for use in an HEUI fuel injection system which is characterized by a flexible design that allows the high pressure pump and/or priming arrangement to be easily plumbed into the fuel injection system.

Still another object of the invention is to provide, in a HEUI system, a charged oil make-up reservoir which is isolated from the high pressure pump so that the charged reservoir maintains only the manifold/rail passages full while a conventional priming reservoir supplies oil including make-up oil, only to the high pressure pump in an arrangement which maintains the reservoir filled to alleviate startup problems associated with an exhausted reservoir.

These objects and other features of the invention will become apparent to those skilled in the art upon reading and understanding the Detailed Description of the Invention set forth below.

BRIEF DESCRIPTION OF THE DRAWINGS

The invention may take form in certain parts and arrangement of parts, a preferred embodiment of which will be described in detail and illustrated in the accompanying drawings which form a part hereof and wherein.

DETAILED DESCRIPTION OF THE INVENTION

Figure 1:
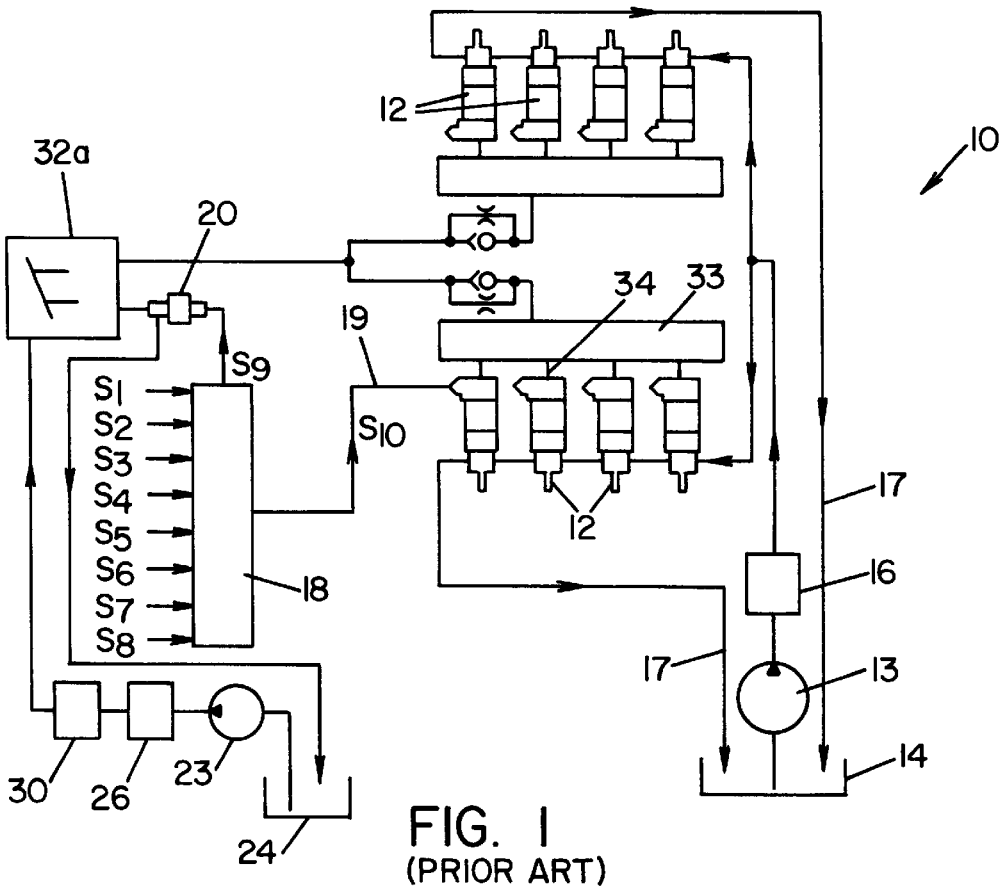
FIG. 1 (PRIOR ART)
FIG. 1 is a Prior Art schematic illustration of an HEUI fuel injection system.
Figure 2:
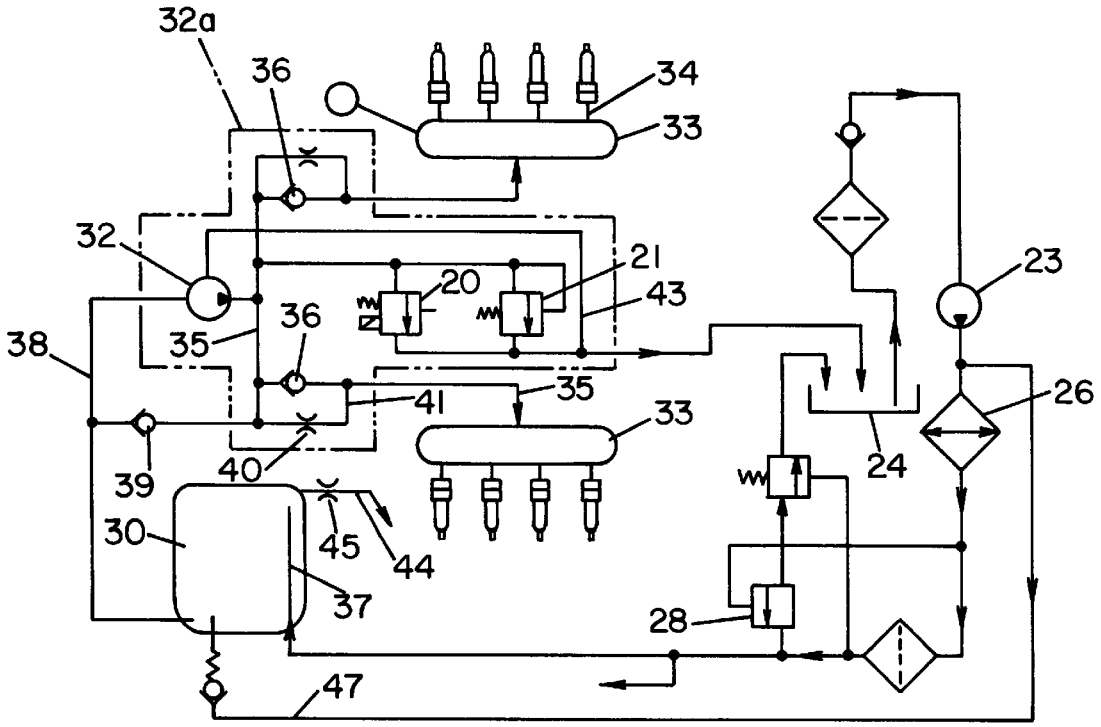
FIG. 2 (PRIOR ART)
FIG. 2 is a Prior Art schematic hydraulic actuating fluid circuit diagram for the injector system shown generally in FIG. 1.

Referring now to the drawings wherein the showings are for the purpose of illustrating the preferred embodiment and alternative embodiments of the invention only and not for the purpose of limiting the same, reference is first had to a description of a prior art HEUI system as shown in FIGS. 1 and 2 since the present invention may be best understood by reference to an existing arrangement. The system shown in FIGS. 1 and 2 will only be described in general terms and reference should be had to the patents incorporated by reference herein for a more detailed explanation of the system including the fuel injector, per se, which is not shown in detail herein.

Referring first to prior art FIG. 1, there is diagrammatically shown an HEUI fuel injection system 10 which includes a plurality of unit fuel injectors 12. A fuel pump 13 draws fuel from the vehicle's fuel tank 14 and conditions the fuel at a conditioning station 16 before pumping the fuel to individual injectors 12 as shown. One or more fuel return lines 17 is provided. The fuel supply system as shown is separate and apart from the hydraulic system which actuates fuel injectors 12.

Fuel injectors 12 are actuated by hydraulic pressure which, in turn, is regulated by signals generated by an electronic control module 18. Module 18, in response to a number of sensed variables, generates electrical control signals which are inputted at 19 to a solenoid valve in each injector and to a pressure control valve 20 which determines the pressure of engine oil pumped to fuel injectors 12.

As shown in prior art FIGS. 1 and 2, oil from the vehicle's conventional oil pump or low pressure pump 23 is cooled by a conventional radiator core 26. A low pressure oil stream produced by a pressure valve 28 fills a priming reservoir 30 which is in fluid communication with the inlet end of a high pressure pump 32. High pressure pump 32 includes the components shown in FIG. 2 within dot-dash line indicative of pump housing 32*a*. High pressure pump 32 pressurizes the engine oil at the high pressure pump's outlet (now termed actuating oil) which is in fluid communication with common rail passage 33 in the manifold which, in turn, is in fluid communication with rail branch passages 34 leading to actuating ports within individual fuel injectors 12. In the prior art arrangement shown in FIGS. 1 and 2, a vee-type engine is used so there are two manifolds and two sets of rails. Also, for convenience in notation, reference to "manifold/rail passages" means the common rail passage 33 and rail branch passages 34 and can optionally include the actuating oil supply line 35 leading from the outlet of high pressure pump 32 to the manifold. When high pressure pump 32 is operating, pressure of the actuating oil in manifold/rail passages 33, 34 is determined by the actuation of pressure control valve 20 which is backed up with a safety relief valve 21.

Referring now to prior art FIG. 2, priming reservoir 30, in addition to functioning as an oil reservoir supplying oil to the inlet of high pressure pump 32, functions also as a reservoir to maintain oil in the high pressure pump inlet supply line 38 and oil in high pressure pump 32 as well as oil in the manifold/rail passages 33, 34 when high pressure pump 32 doesn't operate. This is achieved by physically positioning priming reservoir 30 at an elevation above the inlet port of high pressure pump 32 and above manifold/rail passages 33, 34 and specifically, the use of a stand pipe 37 at that elevation to establish a gravity flow from priming reservoir 30. Make-up oil flows past a one way check valve 39 (oil fairy) through an optional flow restriction orifice 40 in a bypass line 41 which communicates with actuating supply line 35. Orifice 40 in combination with check valves 36 also function to control Helmholtz resonance for balancing pressure surges or waves between the two manifolds for the vee-type engine illustrated. The make-up oil from priming reservoir 30 thus flows to the actuating supply line 35 and then to manifold/rail passages 33, 34. Make-up oil also flows through actuating supply line 35 to the outlet of high pressure pump 32. Leakage within high pressure pump 32 returns to crank case sump 24 through a fluid leakage supply line 43. When priming reservoir 30 is filled by low pressure pump 23 excess oil and air is vented for return to crank case sump 24. In the prior art FIG. 2 this occurs through an overflow return line 44 which includes an orifice 45 to maintain a slight pressure in priming reservoir 30.

As explained, it should be clear that priming reservoir 30 cannot function when high pressure pump 32 is not operating to provide make-up oil to the manifold/rail passages or to the high pressure pump inlet supply line 38 unless priming reservoir 30 is situated at a higher elevation in actuating pump 32 than the manifold/rail passages 33, 34. It should also be clear that priming reservoir 30 functions to supply make-up oil to high pressure pump 32 to account for internal leakages within high pressure pump 32 which drain to crank case sump 24. Priming reservoir 30 is thus functioning to supply make-up oil as a result of leakage and/or volumetric contraction, to the manifold/rail passages 33, 34 and to the internals of high pressure pump 32 itself. When a "cold" engine is started, high pressure pump 32 initially pulls oil from priming reservoir 30 and if priming reservoir 30 has been substantially discharged while providing the make-up oil as described, hard starting will be experienced. The prior art design illustrated has somewhat recognized this problem and has somewhat addressed it by the provision of an additional reservoir fill line 47 which bypasses pressure valve 28 to direct the total output of low pressure pump 23 to filling priming reservoir 30. This assures that priming reservoir remains full when the engine is operating and also, when the engine is stopped. An obvious solution is to increase the size of priming reservoir 30. However, there are engine compartment limitations, even for large commercial vehicles which limit the size of priming reservoir 30.

Figure 3:
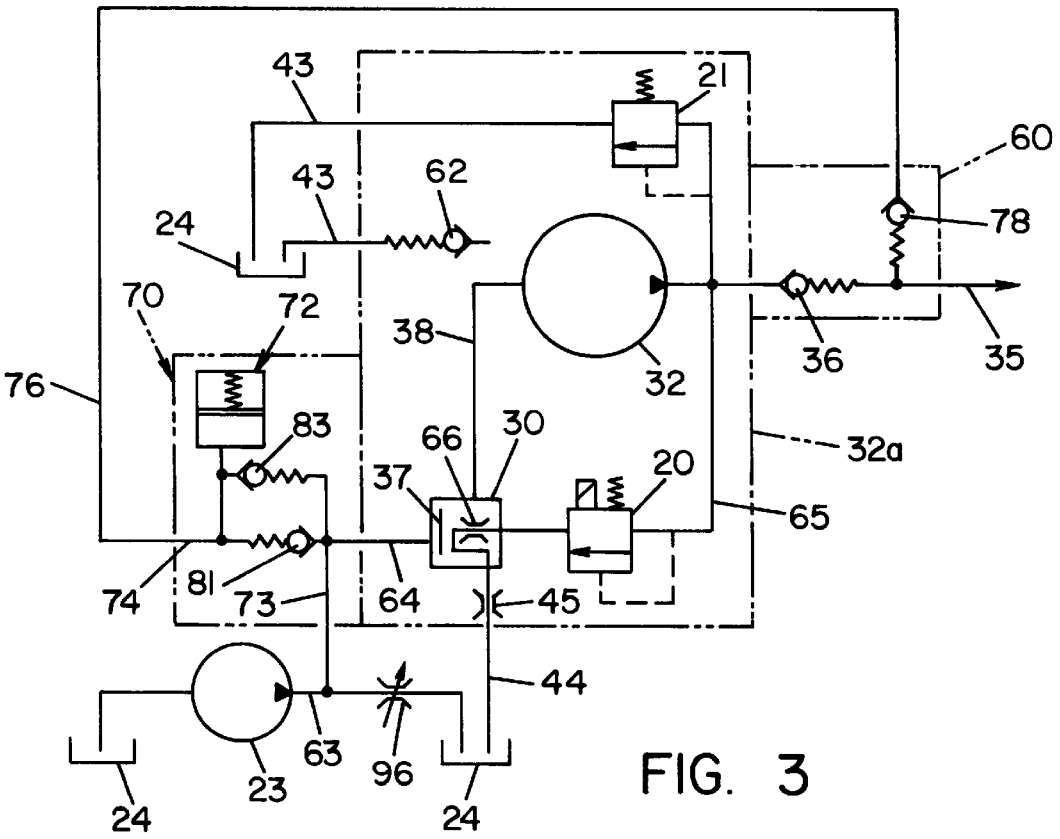
FIG. 3 is a schematic hydraulic circuit illustrating a preferred embodiment of the priming system of the present invention.

A general hydraulic schematic illustrating the preferred embodiment of the present invention is shown in FIG. 3 and the components illustrated in FIG. 3 which are functionally similar to the components illustrated and discussed above with respect to prior art FIGS. 1 and 2 will be assigned the same drawing reference numerals as that used in describing the prior art.

Referring now to FIG. 3, high pressure pump 32 which includes as part of its assembly the elements shown within high pressure pump housing 32*a* is typically a fixed displacement or variable displacement axial piston pump and its outlet is in fluid communication with actuating fluid supply line 35 vis-a-vis one way check valve 36 positioned within a check valve outlet housing 60 affixed to high pressure pump housing 32*a*. Within high pressure pump housing 32*a* is pressure control valve 20 actuated by signals from electronic control module 18 in a conventional manner. A conventional safety relief valve 21 in fluid communication with the outlet of high pressure pump 32 is also provided. Actuation of relief valve 21 dumps pump oil to crank case sump 24 through drain line 43. A one-way drain check valve 62 allows internal leakage of hydraulic fluid within high pressure pump 32 to drain to crank case sump 24 through drain line 43. Conventionally, drain check valve 62 is set to allow flow at a pressure of about 5 psi.

Within high pressure pump housing 32*a*, and in fact, sitting on top of the inlet to high pressure pump 32 is priming reservoir 30. When the engine is operating, priming reservoir 30 is conventionally filled by low pressure pump 23 through a low pressure supply line 63 in fluid communication at 64 with priming reservoir 30. As in the prior art, when priming reservoir 30 is filled it drains to crank case sump 24 through overflow return line 44 and dampening orifice 45 is provided in return line 44. Flow from high pressure pump 32 in return line 65 is regulated by pressure control valve 20 and is returned to crank case sump 24. In contrast to the prior art, priming reservoir 30 is used in the present invention to only insure that make-up oil is supplied to the inlet of high pressure pump 32. Priming reservoir 30 does not supply make-up oil to the manifold/rail passages 33, 34 nor does it supply make-up oil at the outlet of high pressure pump 32. A siphon break 66 is provided within priming reservoir 30. Because priming reservoir 30 is only functioning to prime high pressure pump 32, it is less likely to loose significant oil volume when the engine is inoperable to alleviate the low reservoir volume concern discussed above.

Figure 4:
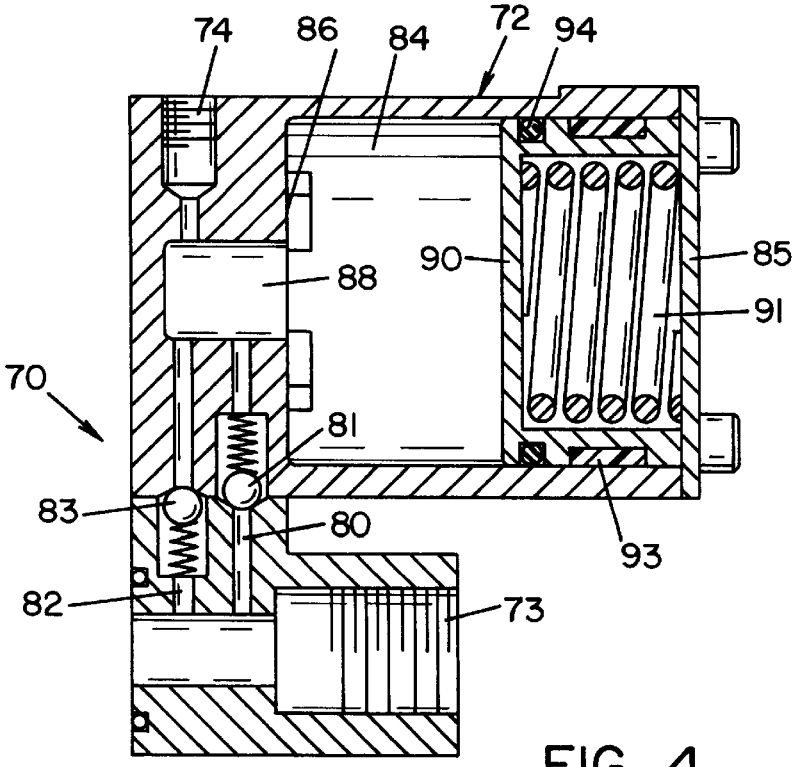
FIG. 4 is a sectioned view of the accumulator used in the present invention.

Referring now to FIGS. 3 and 4, a quick start housing 70 is mounted to the housing 32*a* of high pressure pump 32 and contains a charged vessel or accumulator 72. An inlet 73 to quick start housing 70 is in fluid communication with low pressure supply line 63. An outlet 74 to quick start housing 70 is in fluid communication with a make-up supply line 76 which, in turn, is in fluid communication with actuating fluid supply line 35 through a make-up supply line one way check valve 78 which permits oil to flow to actuating supply line 35 from accumulator 72 but prevents oil from flowing from actuating supply line 35 to accumulator 72. Quick start housing inlet 73 has a first inlet passage 80 in fluid communication with accumulator 72 and contains a spring biased inlet check valve 81 permitting oil to flow from low pressure pump 23 through low pressure supply line 63 to accumulator 72. Quick start housing inlet 73 also has a second return passage 82 which contains a spring biased relief check valve 83 which conventionally operates to allow fluid to flow from make-up supply line 76 through second return passage 82 to crank case sump 24 through low pressure supply line 63. Should a failure occur in make-up supply line one way check valve 78 during engine operation, relief check valve 83 will port the high pressure oil to crank case sump 24. Relief check valve 83 also functions to maintain the pressure of the oil in make-up supply line 76 at a desired pressure when the engine is not operating which is sufficient to insure priming of the manifold/rail passages without excessive pressure tending to promote leakage through fuel injectors 12. In the preferred embodiment, this pressure is typically set at about 5–15 psi.

Referring now to FIG. 4, accumulator 72 can be any conventional accumulator capable of storing fluid at a preset charge or pressure and could utilize a bellows or a diaphragm for such purpose. In the preferred embodiment, a spring biased piston arrangement is employed. In the preferred embodiment, accumulator 72 includes a cylindrical chamber 84 closed at one of its ends 85 and open at its opposite end 86 forming an inlet/outlet chamber 88 which, in turn, is in fluid communication with quick start housing outlet 74 and quick start inlet 73 vis-a-vis first and second passages 80, 81. Disposed within cylindrical chamber 84 is a cup shaped piston 90 containing a compression spring 91 compressed between closed end 85 and biasing piston 90 towards inlet/outlet chamber 88. An annular guide ring 93 between piston 90 and cylindrical chamber 84 assures non-cocked, straight line motion of piston 90 within cylindrical chamber 84 and an elastomer seal 94 prevents leakage of the oil past piston 90.

The operation of accumulator 72 is believed apparent from the discussion above. Some comments may nevertheless be appropriate. In the preferred embodiment, the size of accumulator 72 is 90 cc. The relief check valve 83 operates at less than 100 psi and inlet check valve 81 operates at less than 5 psi. Thus, the pressure within cylindrical chamber 84 and make-up supply line 76 is set by spring 91 at 5–15 psi. The pressure in low pressure supply line 63 is established by the conventional prior art control (discussed in the patents above) and is diagrammatically shown in FIGS. 3, 5 and 6 and designated in short hand notation by variable orifice 96. Check valves 78, 81 and 83 completely isolate accumulator 72 from high pressure pump 32.

Priming reservoir 30 is gravity fed and sits atop pump 32. This is the same position priming reservoir 30 occupies in the prior art. However, one of the differences between the present invention and the prior art is that pump 32 can be situated anywhere within the engine compartment and preferably below manifold/rail passages 33, 34. When the engine is operating, fluid flow in the accumulator 72 make-up system is essentially static, i.e., no movement in make-up supply line 76. As noted in the prior art references, the output from high pressure pump 32 varies anywhere from 300 to 3000 psi in actuating supply line 35 depending upon the setting of pressure control valve 20. Make-up supply line one way check valve 78 prevents fluid at this pressure from flowing into make-up supply line 76. Should make-up supply line one way check valve 78 fail, flow from high pressure pump 32 will return to crank case sump 24 through relief check valve 83 and priming reservoir 30. Low pressure pump 23 will function to fill priming reservoir 30 and a filled priming reservoir 30 is assured. Thus, it is not possible for priming reservoir 30 to be exhausted or emptied during engine operation.

When the engine is turned off, piston 90 is effective to supply make-up fluid to the manifold/rail passages vis-a-vis make-up supply line 76, make-up supply line one way check valve 78, and actuating fluid supply line 35. Importantly, high pressure pump one way check valve 36 prevents any make-up oil from accumulator 72 communicating with high pressure pump 32. Thus, accumulator 72 and the makeup supply system is isolated from high pressure pump 32. At the same time, high pressure pump 32 is primed by priming reservoir 30. In the preferred embodiment the size of priming reservoir 30 is the same as that of the prior art and since this volume is entirely available to maintain pump 32 primed, it would be unusual for this reservoir to be depleted under any startup condition.

Figure 5:
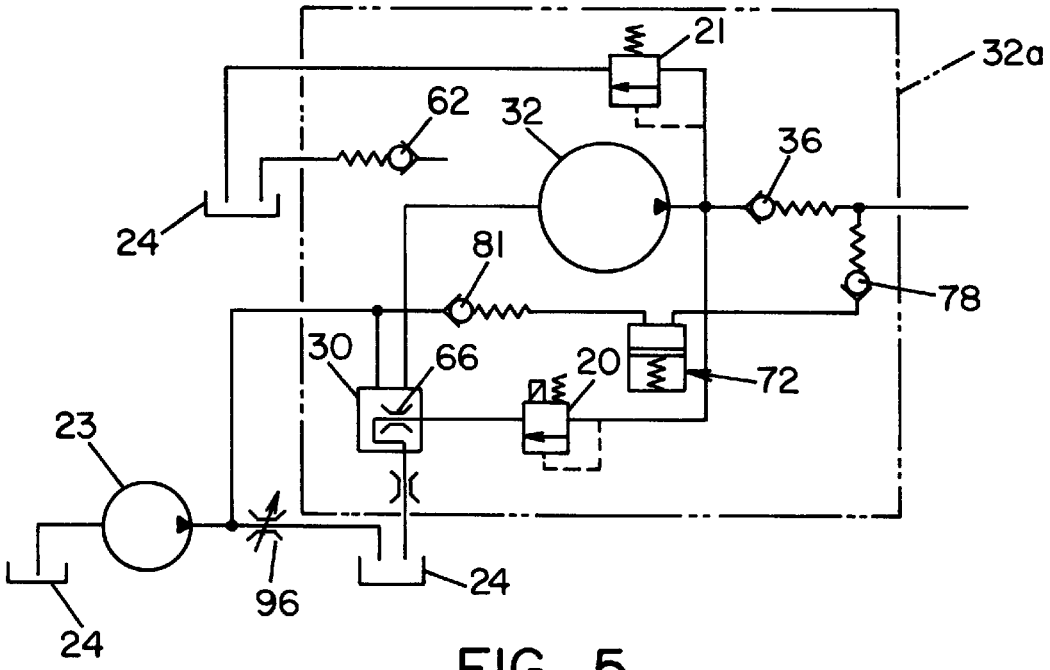
FIGS. 5 and 6 are general schematic hydraulic circuits illustrating alternative embodiments of the present invention; and, FIG. 7 is a partial perspective view of an internal combustion engine showing the position of the high pressure pump and priming system of the present invention.
Figure 6:
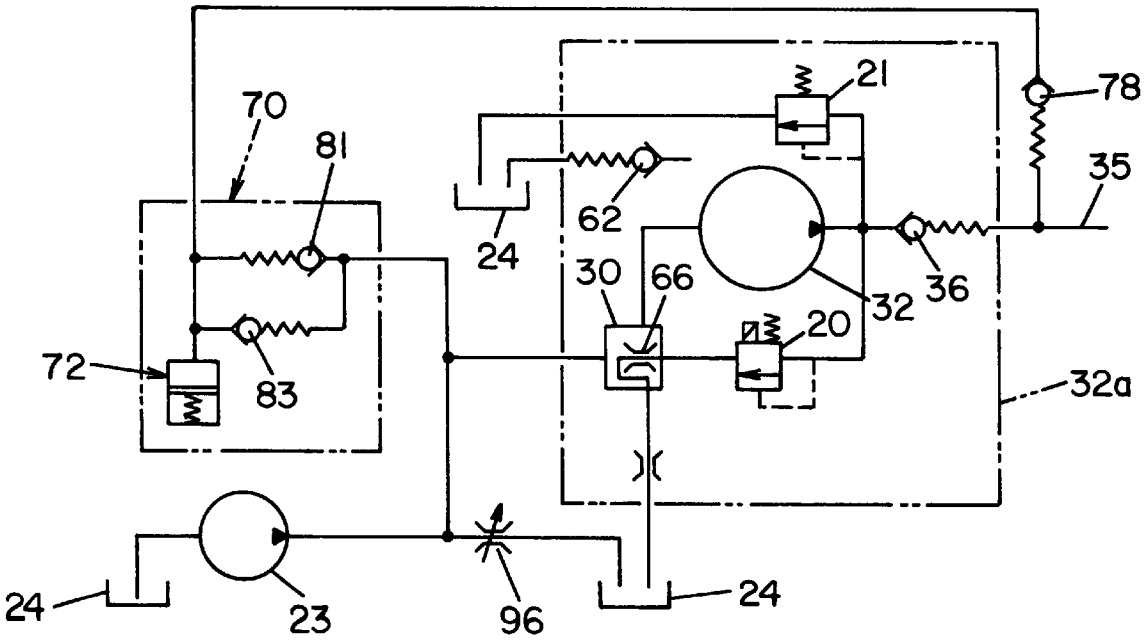

Alternative embodiments are illustrated in FIGS. 5 and 6 and the reference numerals used to define and explain the components of the prior art in FIGS. 1, 2 and the preferred embodiment of the present invention in FIG. 3 will likewise apply to the components of the alternative embodiments illustrated in FIGS. 5 and 6.

Figure 7:
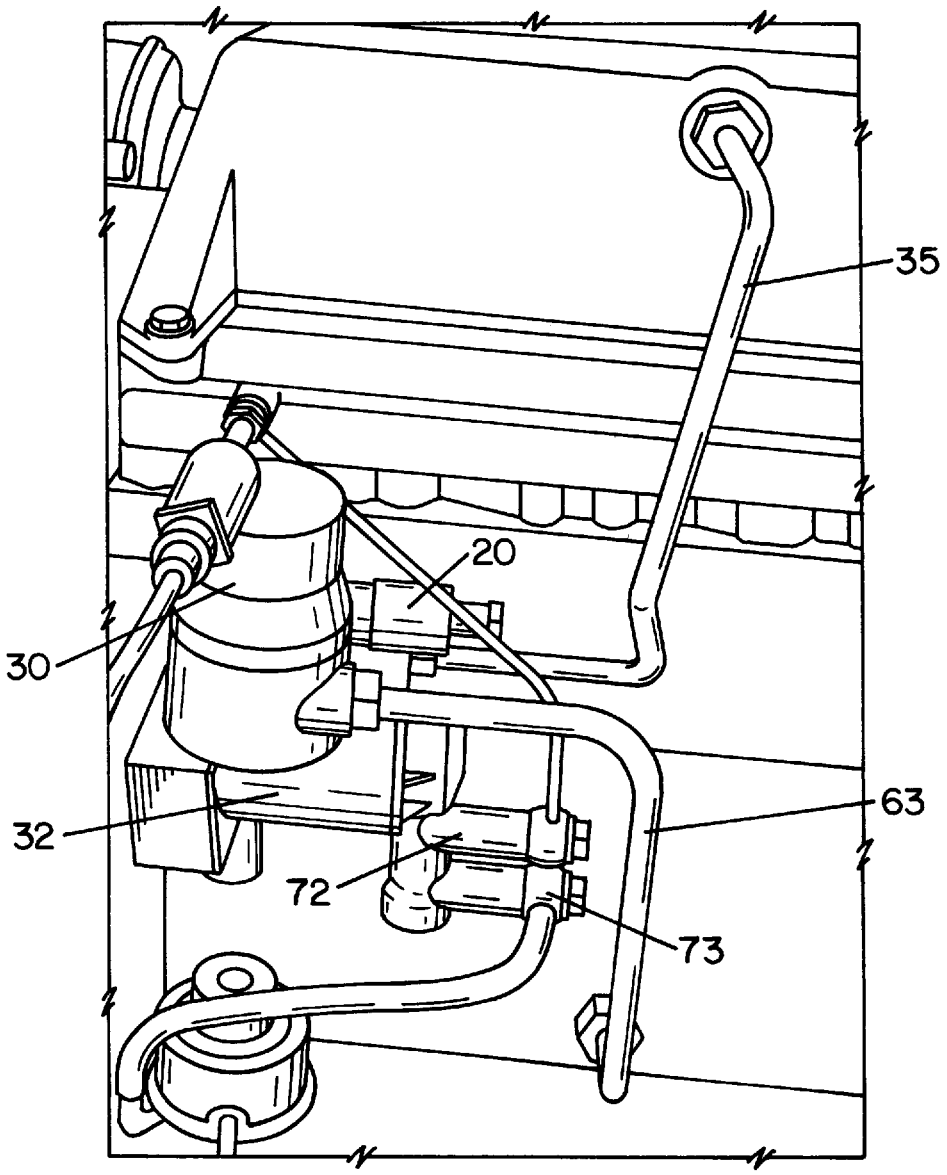

The alternative embodiment shown in FIG. 5 is for all intents and purposes identical to FIG. 3 except that FIG. 5 shows accumulator 72 positioned internally within or integrally formed as part of pump housing 32*a*. Relief valve 83 is optionally omitted from this embodiment. It could be included. The alternative embodiment disclosed with respect to FIG. 6 is identical to the arrangement described with reference to FIG. 3 except that quick start housing 70 is shown remote from pump housing 32*a*. In addition, check valve housing 60 (as in FIG. 5) is eliminated. FIGS. 3, 5 and 6 together simply illustrate the flexibility of the present invention to be applied into any number of pump configurations which may be dictated by the space within the engine compartment. This is best illustrated in FIG. 7 which shows a portion of the vehicle's engine compartment. Pressure pump 32 is situated well below the engine's intake manifold containing manifold/rail passages 33, 34. As noted above, space considerations within the engine compartment are critical for certain vehicles such as SUV applications.

The invention has been described with respect to a preferred embodiment and several alternative embodiments. Obviously, alterations and modifications will suggest themselves to those skilled in the art upon reading and understanding the Detailed Description of the Invention set forth herein. It is intended to include all such modifications and alterations insofar as they come within the scope of the present invention.

Having thus defined the invention, it is claimed:

1. In an engine having a hydraulically-operated, electronically-controlled fuel injection system of the type including a fuel injector, means for supplying fuel to the injector, a high pressure pump in fluid communication through an actuating supply line with a manifold in fluid communication in turn with said injector and means for controlling the pressure of said high pressure pump separately from said fuel supply means for actuating said injector, the improvement comprising:

a) a low pressure pump;

b) an accumulator having an inlet and an outlet;

c) check valve means between said inlet and said low pressure pump for charging said accumulator at a preset pressure lower that of said high pressure pump; and d) a make-up fluid supply line in fluid communication with said actuating supply line, said make-up supply line having a one way check valve between said accumulator outlet and said actuating supply line whereby said accumulator maintains said manifold in a primed condition at all times when said high pressure pump is inoperable.

2. The improvement of claim 1 wherein said accumulator is positioned at an elevation below that of said manifold.

3. The improvement of claim 2 wherein said accumulator is affixed to said high pressure pump.

4. The improvement of claim 2 wherein said accumulator is remote from said high pressure pump.

5. The improvement of claim 2 wherein said accumulator is integrally formed with said high pressure pump.

6. The improvement of claim 1 wherein said low pressure pump has an outlet in fluid communication with a low pressure fluid supply line, a pressure control valve in said low pressure supply line for controlling the pressure of fluid from said low pressure pump, said low pressure supply line in fluid communication with a fluid sump downstream of said check valve means.

7. The improvement of claim 6 wherein said check valve means includes said accumulator's inlet having a first and a second inlet passage; a reservoir one way check valve in said first inlet passage providing fluid communication from said low pressure pump to said accumulator while preventing fluid communication from said accumulator to said low pressure pump and a one way relief check valve in said second inlet passage providing fluid communication from said reservoir to said fluid sump when the fluid pressure in said reservoir exceeds a second preset pressure.

8. The improvement of claim 7 wherein said accumulator includes a cylindrical chamber closed at one end and open to said accumulator's inlet and outlet at its opposite end, a piston sealingly disposed within said cylindrical chamber and spring biasing means between said piston and said closed end biasing said piston towards said open end.

9. The improvement of claim 8 wherein said low pressure pump is a lubricating oil pump used in said engine and said sump is an oil sump in said engine for said lubrication oil pump.

10. In an engine having a lubricating oil pump, an oil sump, and a hydraulically-operated, electronically controlled fuel injection system, said system including a fuel injector, means for supplying fuel to said injector, a high pressure pump, manifold/rail passage means for providing fluid communication of high pressure lubricating oil from said high pressure pump to said injector, valve means associated with said injector for controlling fuel expelled from said injector by the pressure of said lubricating oil from said high pressure pump, the improvement comprising:

a) an accumulator having an inlet and an outlet;

b) a low pressure supply line from said lubricating oil pump returning to said sump and in fluid communication with said inlet of said accumulator, said low pressure supply line having fluid at a first pressure lower than that produced by said high pressure pump;

c) check valve means associated with said accumulator inlet for charging said accumulator with lubricating oil from said oil lubricating pump through said low pressure supply line at a second preset pressure; and d) a make-up supply line extending from said outlet of said accumulator to said manifold/rail passage means and a one way check valve in said make-up supply line providing fluid communication from said accumulator's outlet to said manifold/rail passage means while preventing fluid communication of lubricating oil from said manifold/rail passage means to said accumulator whereby said accumulator maintains said passage means primed with lubricating oil.

11. The improvement of claim 10 wherein said check valve means includes said accumulator's inlet having a first and a second inlet passage; a reservoir one way check valve in said first inlet passage providing fluid communication from said low pressure pump to said accumulator while preventing fluid communication from said accumulator to said low pressure pump and a one way relief check valve in said second inlet passage providing fluid communication from said reservoir to said fluid sump when the fluid pressure in said reservoir exceeds said second preset pressure.

12. The improvement of claim 11 wherein said manifold/rail passage means includes a manifold and a rail in fluid communication with said injector, said pressurized reservoir being below the elevation of said manifold.

13. The improvement of claim 12 wherein said accumulator is separate and apart from said high pressure pump.

14. The improvement of claim 12 wherein said accumulator is attached to said high pressure pump.

15. The improvement of claim 12 wherein said accumulator is formed integral with said high pressure pump.

16. The improvement of claim 11 wherein said accumulator includes a cylindrical chamber closed at one end and open to said accumulator's inlet and outlet at its opposite end, a piston sealingly disposed within said cylindrical chamber and spring biasing means between said piston and said closed end biasing said piston towards said open end.

* * * * *